United States Patent [19]

Cunningham

[11] Patent Number: 4,867,427

[45] Date of Patent: Sep. 19, 1989

[54] CLAMP FOR WELDING PLATENS

[76] Inventor: Paul D. Cunningham, 469 Camden Ave., Moorestown, N.J. 08057

[21] Appl. No.: 226,940

[22] Filed: Aug. 1, 1988

[51] Int. Cl.[4] ..... B25B 1/00

[52] U.S. Cl. ..... 269/88; 269/93; 269/166; 269/900

[58] Field of Search ..... 269/166–171.5, 269/45, 91–94, 305, 900, 910, 88, 104

[56] References Cited

U.S. PATENT DOCUMENTS

| | | | |
|---|---|---|---|
| 1,793,560 | 2/1931 | Schmieder | 269/166 |
| 2,157,345 | 5/1939 | Nelson | 269/166 |
| 4,753,425 | 6/1988 | Yang | 269/45 |

*Primary Examiner*—Robert C. Watson
*Attorney, Agent, or Firm*—Austin R. Miller

[57] ABSTRACT

A clamp adapted to engage a clamp receiving hole in a welding platen for tightly clamping a workpiece in a desired position. The clamp includes an elongated upright capable of extending into the hole, a stop member extending outwardly from a lower portion of the upright, the stop being wider than the mouth of the hole, thereby limiting the distance the upright extends into the hole, a clamping arm slidably mounted to the upright, the clamping arm comprising a frame portion, an elongated neck extending from the frame and a sleeve connected to the neck and engaging the upright, the sleeve permitting changes in the angular position of the neck with respect to the upright. The clamp further includes a threaded screw connected to the frame and capable of applying force to the workpiece wherein tightening of the threaded screw against the workpiece causes the clamping arm to pivot with respect to the upright, thereby causing the upright to tilt and tightly engage opposing sides of the hole which causes the upright to remain wedged in the hole and the workpiece to be tightly clamped.

17 Claims, 9 Drawing Sheets

CLAMP FOR WELDING PLATENS

BACKGROUND OF THE INVENTION

The present invention relates to a clamp adapted for use on welding platens, particularly to a clamp insertable into holes in the surface of welding platens to tightly and rigidly clamp a workpiece in a desired position.

FIELD OF THE INVENTION

Welding together workpieces typically involves the need for rigidly positioning the workpieces adjacent to one another to achieve a viable weld. Movement of the workpieces with respect to one another during welding can cause severe damage to the quality of the resulting weld.

Welding platens provide a stable platform upon which welding of one or more workpieces can take place. Typically, such platens have a multiplicity of holes extending through their top surfaces. These holes are typically square in dimension and are provided for the insertion of various conventional welding clamps.

However, over time, and by way of use, welding platens tend to be subjected to physical abuse by workpieces being welded, various tools used during welding, clamps and the like. For example, workpieces can weigh hundreds of pounds and are capable of denting or causing irregularities in platen surfaces. This often manifests itself in the upper edges of the standard sized square holes being distorted or deformed. Such deformation prevents insertion of a clamping member into the hole. When it is no longer possible to insert the clamp into appropriately located holes, it may no longer be possible to achieve tight clamping of the workpieces to the platen to produce a stable weld surface. After extended periods of time, many of the holes become distorted to the extent that locating an available hole for clamping at the proper position is not possible with conventional clamps.

Proper location is important in that welding typically takes place in precise positions and within close tolerances. Therefore, it is highly desirable to be able to clamp respective workpieces into such precise positions. If such clamping positions are not available due to distortion of platen holes, then weld quality may be jeopardized.

DESCRIPTION OF THE PRIOR ART

U.S. Pat. No. 1,954,708 discloses a work holding clamp and drill jig consisting of a vertical square post extending downwardly through square holes in a layout plate. The clamp has an inclined clamping screw mounted in an inclined threaded opening in a swiveled head carried by a post. The post has a vertical socket forming a tubular portion for the post and for receiving a vertical stem formed integrally with and extending downwardly from the head. A work piece is clamped into position by threading the inclined screw through the inclined threaded opening. The clamp is especially subject to square hole distortion. The square post fits closely into the square holes and, upon sufficient distortion, can no longer be inserted.

U.S. Pat. No. 2,877,815 discloses a canting holed-down clamp wherein a shank extends through a bore in a bushing in the top of a bench. Actuation of downward pressure by a screw member and swiveling foot causes the shank to cant out of vertical and engage one of several shoulders against the undersurface of the retaining flange on the bench top. The engagement prevents the shank from popping out of the bushing and permits clamping force to be applied to the workpiece. However, without the retaining flange and shoulders, the clamp tends to pop out of the bushing in the bench top.

U.S. Pat. No. 4,143,869 discloses an adjustment clamp having a tiltable sleeve fixable along an upright post. Rotation of a screw causes an arm portion to move upwardly or downwardly with respect to a box-like clamping jaw in order to actuate clamping of a workpiece. However, this clamp is not suitable for insertion into square holes of welding platens and, therefore, is unsuitable for most welding applications.

Other patents known to applicant include U.S. Pat. Nos. 555,614, 4,209,166, 102,487, 229,776, 437,403, 737,527, 739,365, 2,877,815, 2,913,965 and 4,238,124.

OBJECTS OF THE INVENTION

It is an object of the present invention to provide a clamp for use in conjunction with welding platens.

It is another object of the present invention to provide a clamp capable of insertion into standardized square welding holes in welding platens even after substantial distortion of the upper edges of such holes without the need for tightening and loosening tools.

It is a most important object of the present invention to provide a single clamp capable of clamping both vertically and/or horizontally workpieces for welding.

It is an important object of the present invention to provide a clamp which is capable of interchanging between horizontal and vertical clamping on a welding platen.

Other objects and advantages of the present invention will become apparent to those skilled in the art from the drawings, the detailed description of preferred embodiments and the appended claims.

SUMMARY OF THE INVENTION

The present invention provides a clamp adapted to engage a clamp receiving hole in a welding platen for tightly clamping either horizontally or vertically a workpiece in a desired position. The clamp preferably consists of an elongated base member capable of extending into the square hole. A flange extends radially outwardly from an upper portion of the base, with the flange being wider than the mouth of the square hole to limit the distance the base extends into the hole. An elongated upright extends outwardly from an upper portion of the base and a clamping arm is slidably mounted to the upright.

The clamping arm consists of a frame portion, an elongated neck extending from the frame and a sleeve connected to the neck and engaging the upright. The sleeve permits changes in the angular position of the neck with respect to the upright. The clamp also consists of a threaded workpiece engaging means connected to the frame and capable of applying force to the workpiece in conjunction with the clamping arm and upright.

DETAILED DESCRIPTION OF THE INVENTION

Figure 1:
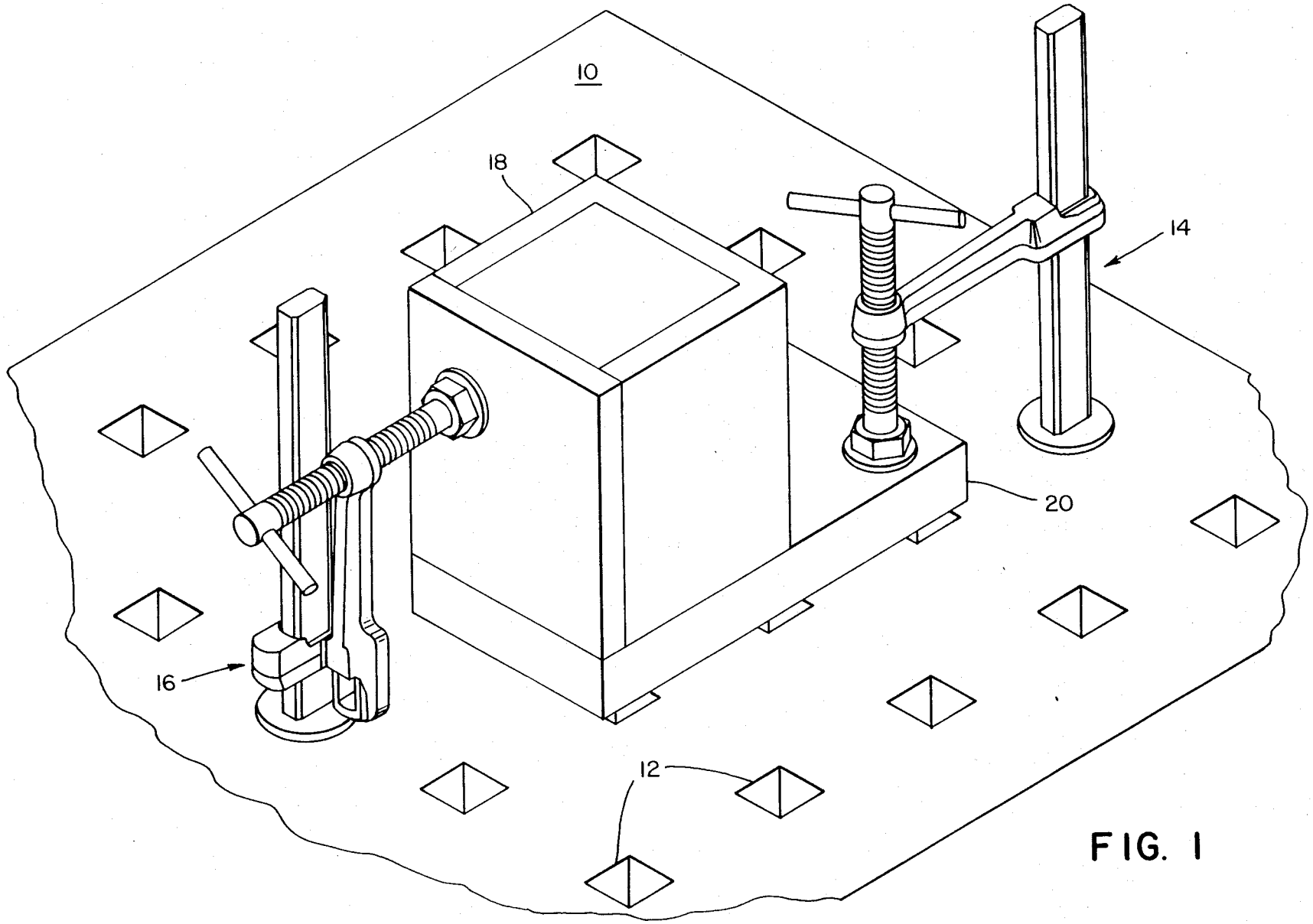
FIG. 1 shows a perspective view of clamps embodying aspects of the invention applied to a welding platen and holding a workpiece in a desired position.

Although a particular form of apparatus and method has been selected for illustration in the drawings, and although specific terms will be used in the specification, for the sake of clarity in describing the apparatus and method step shown, the scope of this invention is defined in the appended claims and is not intended to be limited either by the drawing selected or the terms used in the specification or abstract.

As shown in FIG. 1, which is a perspective view, a welding platen 10 has a multiplicity of standard size square holes 12 adapted for receiving welding clamps. Vertical clamp 14 and horizontal clamp 16 are positioned on welding platen 10 within square holes 12. Clamps 14 and 16 clamp workpiece 18 and wedgepiece 21 in desired positions.

Figure 2:
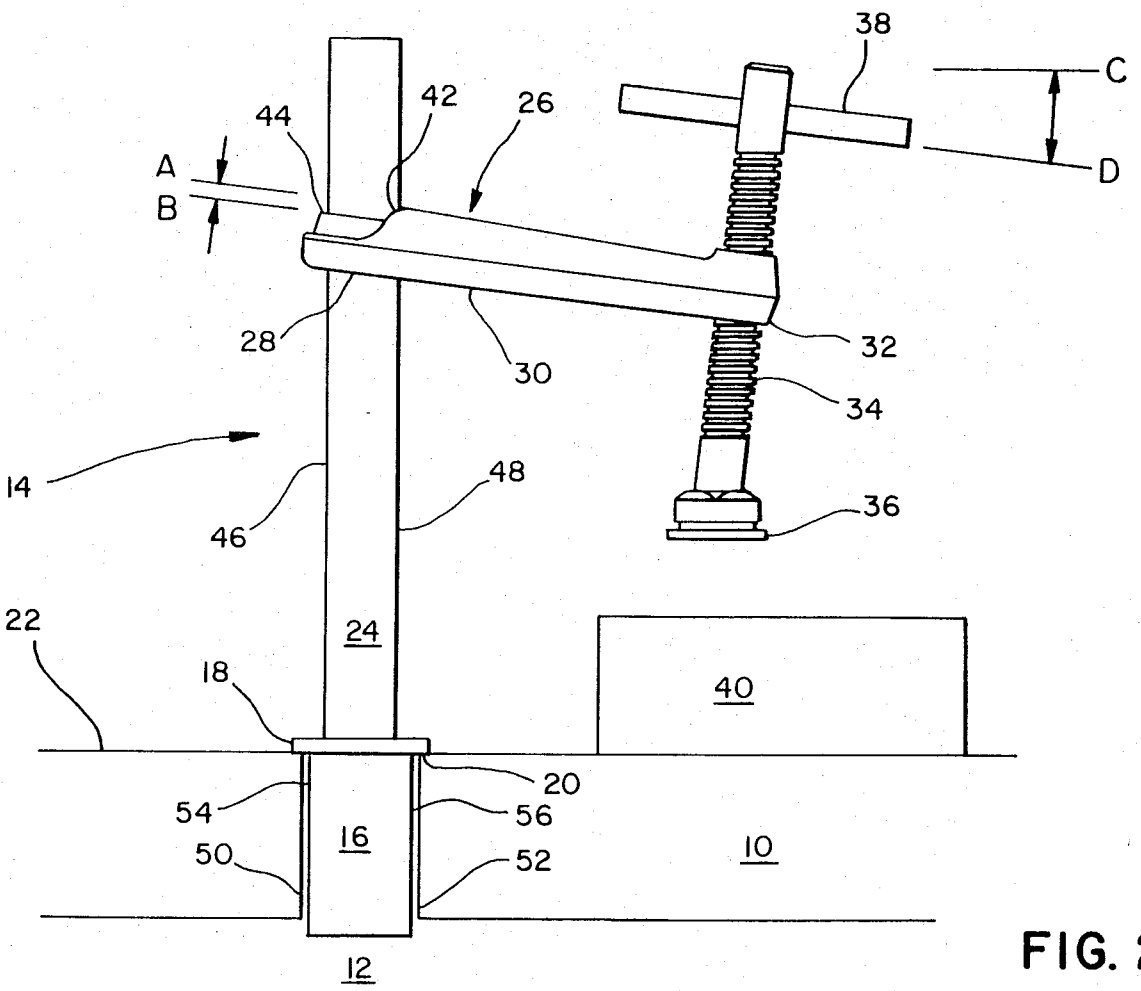
FIG. 2 is a side elevational view of a clamp in accordance with the present invention positioned in a welding platen hole prior to vertically clamping a workpiece.

Referring now to FIG. 2, vertical clamp 14 is shown mounted to platen 10 in a square hole 12. Clamp 14 has a substantially cylindrically shaped base 16 which extends into square hole 12. Base 16 has a diameter sufficiently small to fit within industrially standardized square holes 12. A radially outwardly extending flange 18 connects to the top of base 16. Undersurface 20 of flange 18 lies against upper surface 22 of platen 10. Upright 24 extends longitudinally upwardly from base 16 and flange 18 and contains removable pin 25.

Clamp 14 has a slidably mounted clamping arm 26 which consists of sleeve portion 28 surrounding upright 24, neck 30 extending longitudinally from sleeve 28 and frame 32 connected to the opposite end of neck 30. Threaded clamping bolt 34 engages threads interiorly disposed within frame 32 and has foot 36 on one end and tightening pin 38 on the other end.

Sleeve 28 is specifically designed and sized to permit sliding movement along upright 24. Sleeve 28 further permits specifically designed slight pivotal movement of clamping arm 26. This is accomplished by having raised edge 42 adjacent neck 30. Sleeve 28 also has lowered edge 44 on the side opposite raised edge 42. The presence of lowered edge 44 permits sleeve 28 to ride upwardly along left side 46 of upright 24 and simultaneously permits sleeve 28 to ride downwardly along right side 48 of upright 24. Such pivoting permits movement of clamping arm 26 downwardly from a horizontal position, designated by line C, to a lower position designated by line D. The height difference between raised edge 42 and lowered edge 44 as designated by the lines A and B, respectively, permits such pivotal movement.

Figure 3:
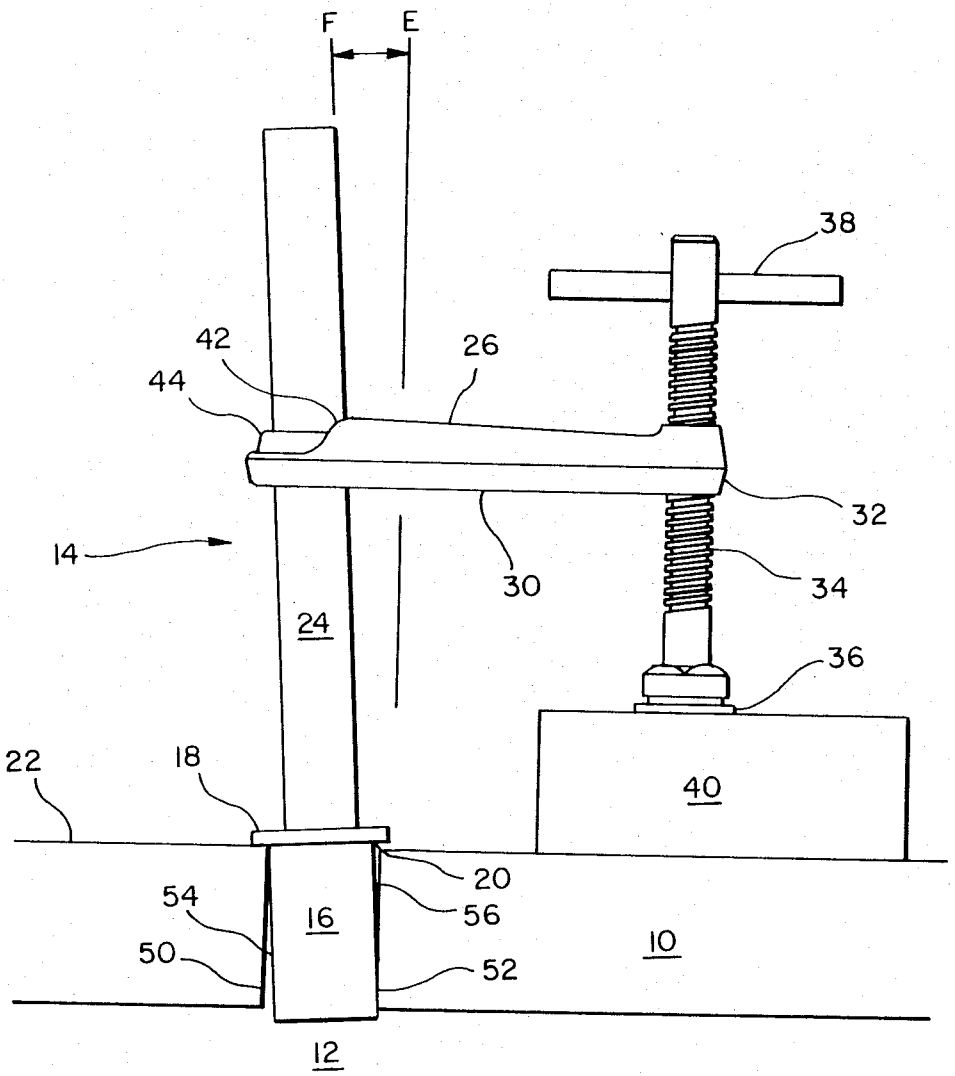
FIG. 3 is a side elevational view of the clamp shown in FIG. 2 vertically clamping a workpiece in position.

FIG. 3 shows clamp 14 clamping workpiece 40. Base 16 is positioned within square hole 12 and platen 10. Under surface 20 of flange 18 partially rests on upper surface 22 of platen 10 and upper portion of left side surface 54 of base 16 contacts left wall 50 of square hole 12 and a lower portion of right side surface 56 of base 16 contacts right wall 52 of square hole 12.

Upright 24 is tilted out of vertical as shown by lines E and F. Clamping arm 26 has been pivoted upwardly to a horizontal or close to horizontal position. Clamping bolt 34, in conjunction with foot 36, applies force to workpiece 40, thereby tightly clamping it into position on upper surface 22 of platen 10.

Figure 4:
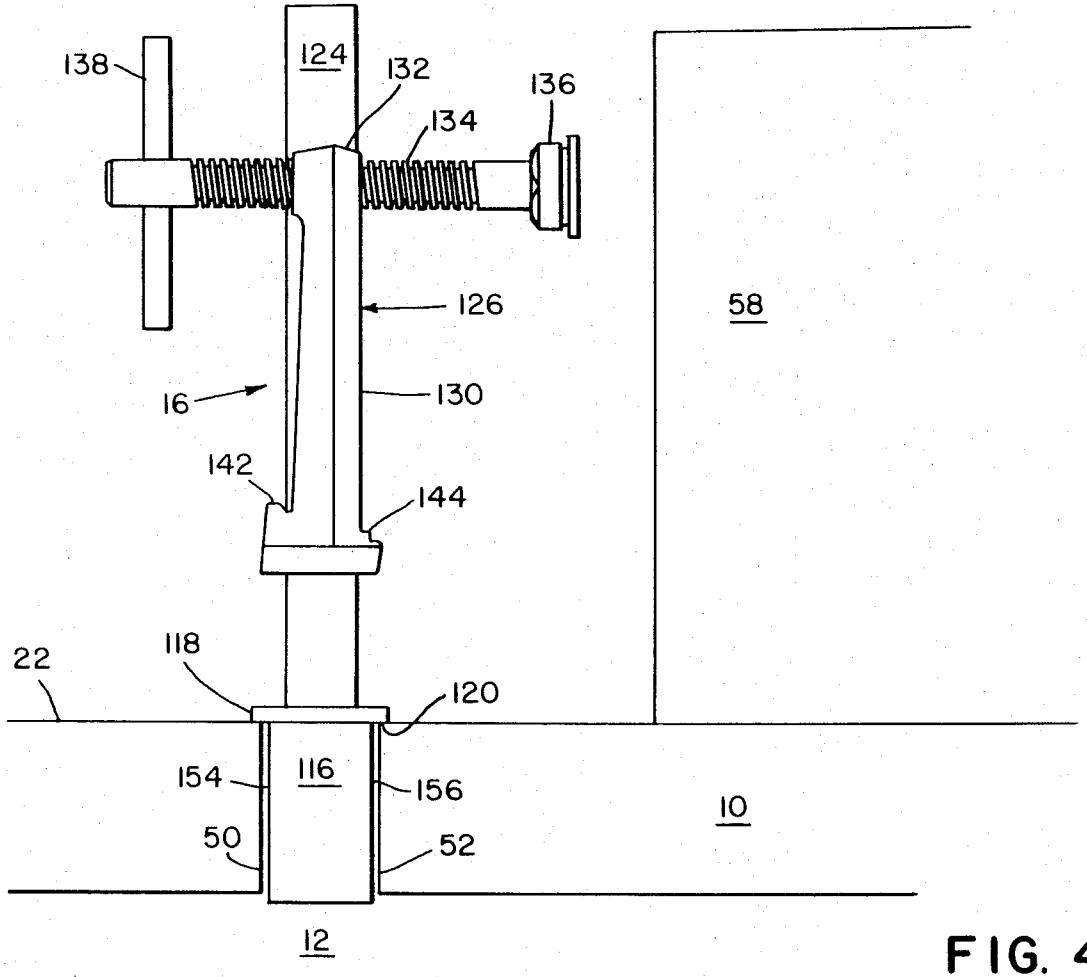
FIG. 4 is a side elevational view of another embodiment of the clamp of the invention positioned in a welding platen hole prior to horizontally clamping a workpiece.

FIG. 4 shows horizontal clamp 16 positioned on platen 10 prior to clamping workpiece 58. Clamp arm 126 rides substantially vertically along upright 124, with clamping bolt 134 position substantially horizontally prior to contact with workpiece 58.

Base 116 resides within hole 12 with left side and right side surfaces 154 and 156 remaining substantially out of contact with left and right walls 50 and 52. Under surface 120 of flange 118 lies substantially in contact with upper surface 22 of platen 10.

Figure 5:
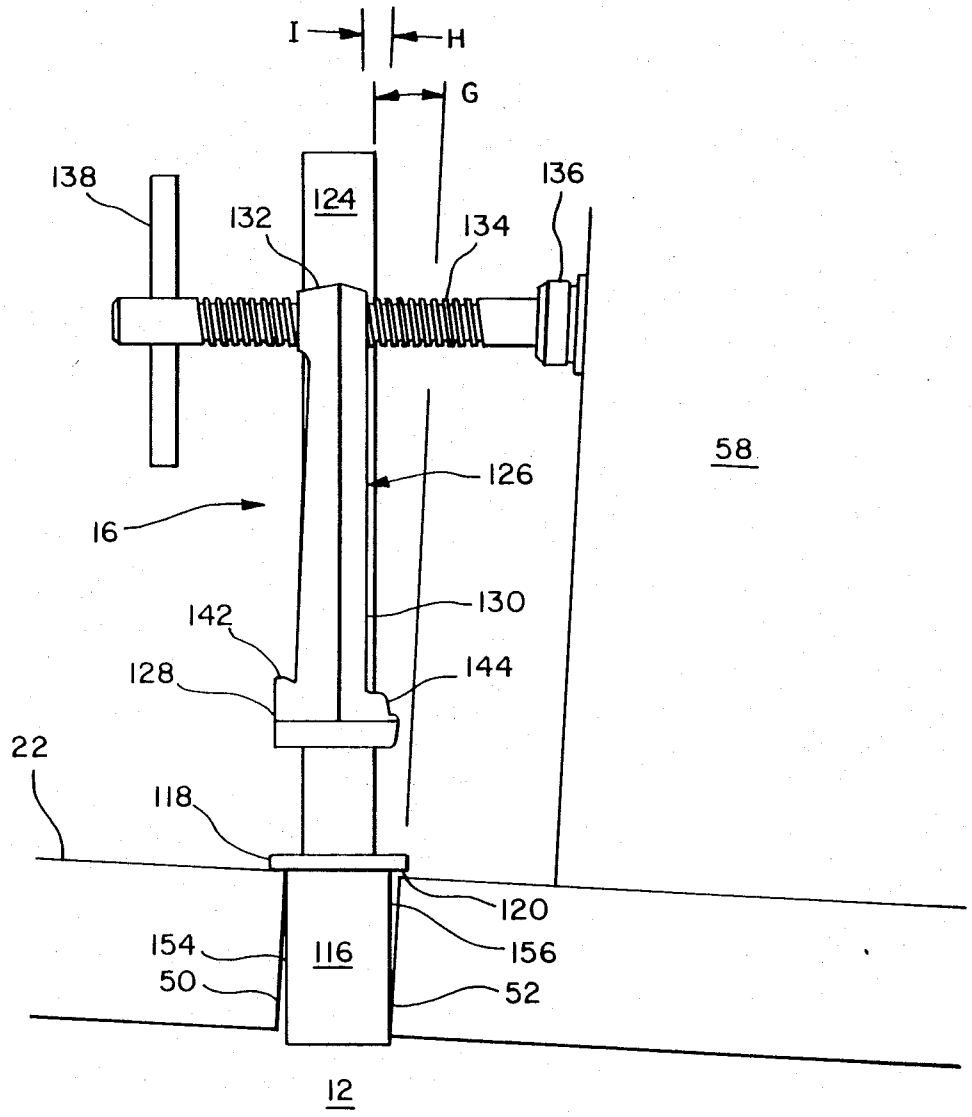
FIG. 5 is a side elevational view of the clamp shown in FIG. 4 horizontally clamping a workpiece in a desired position.

FIG. 5 shows clamp 16 tightly engaging and clamping workpiece 58. Upright 124 is displaced out of vertical by the distance shown by arrow G caused by application of force against clamping bolt 134 and foot 136. Similarly, clamping arm 126 is out of vertical with respect to upright 124 by the distance shown between the arrows H and I, also caused by force applied by clamping bolt 134 and foot 136. The pivot distance between arrows H and I is permitted by lowered edge 144 of sleeve 128 allowing lowered edge 144 to ride upwardly along right side 148 of upright 124.

Base 116 is also out of vertical as shown by the upper portion of left side surface 154 contacting an upper portion of left wall 50 and a lower portion of right side surface 156 contacting a lower portion of right wall 52. Flange 118 is partially pivoted upwardly off of upper surface 22 as shown by the partial contact of under surface 120 against upper surface 22.

Figure 6:
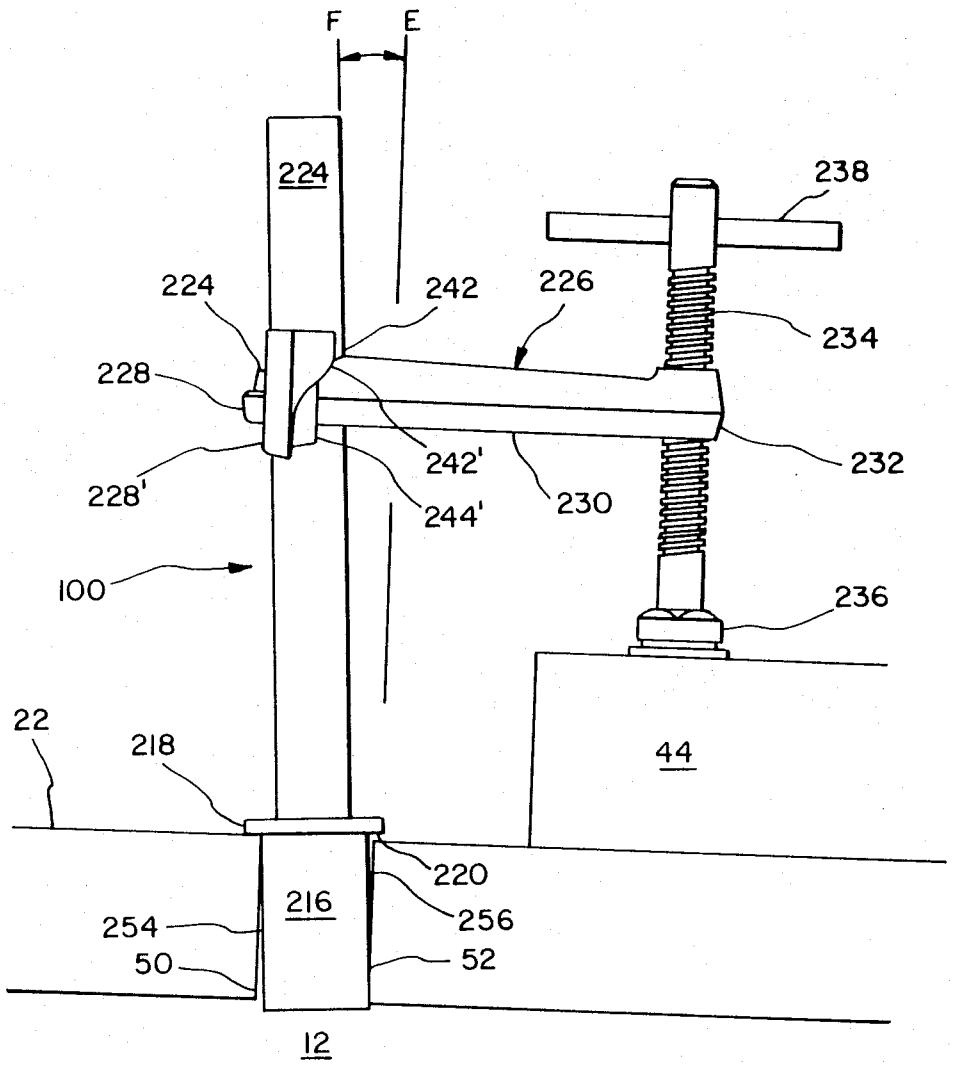
FIG. 6 is a side elevation view of still another embodiment of the invention clamping a workpiece in a desired position.

FIG. 6 shows another embodiment of clamp 100 in accordance with the invention similar to the clamp shown in FIG. 3. Clamp 100 is, however, outfitted with a second sleeve 228' having raised edge 242 and lowered edge 244. The presence of second sleeve 228' permits clamping arm 26 to be removed from upright 24 and rotated 90° to have second sleeve 228' engage upright 24 for horizontal clamping. Pivot action of sleeves 228 and 228' operates similarly to that of sleeves 28 and 128, respectively, as shown in FIGS. 3 and 5.

Figure 7:
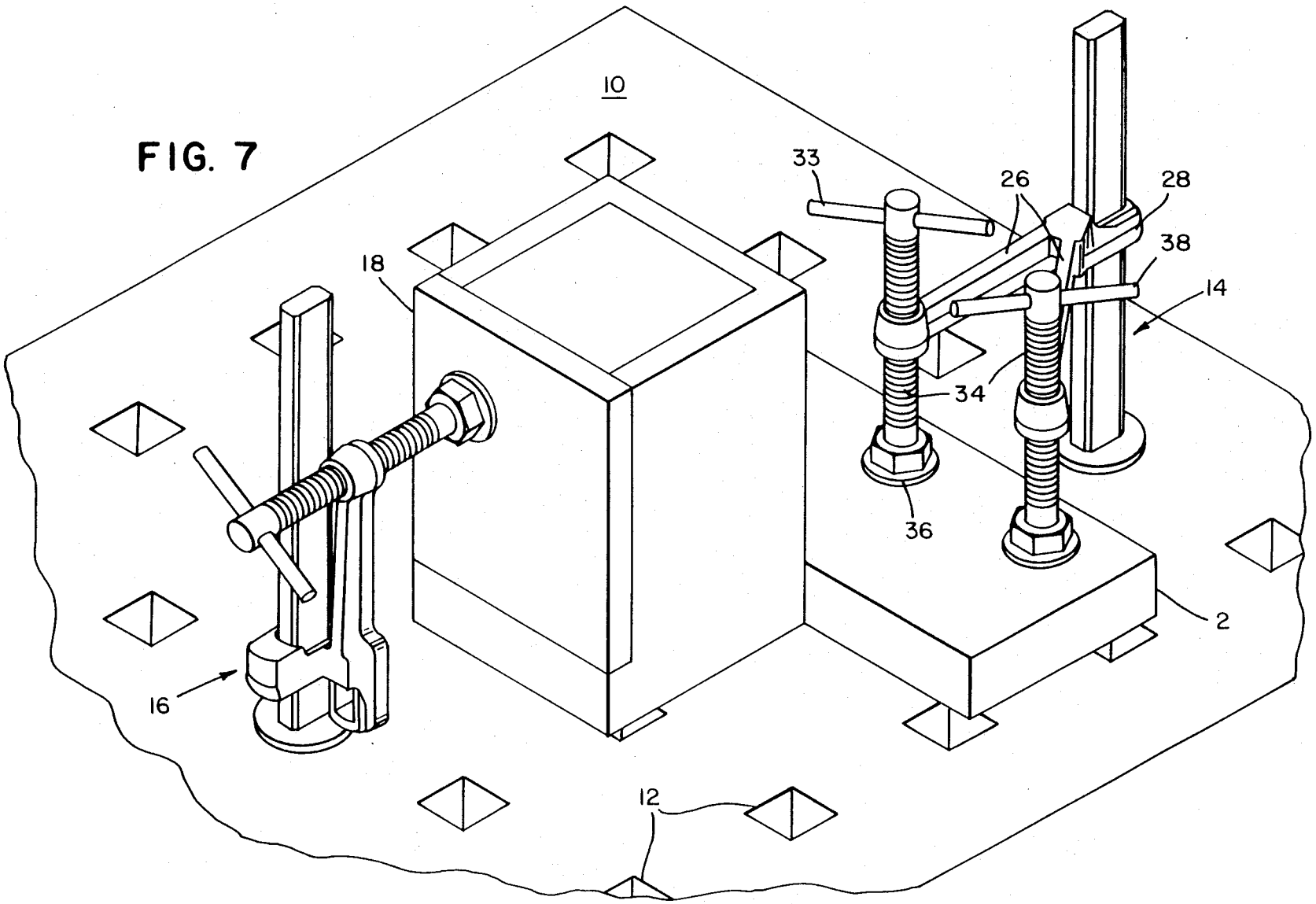
FIG. 7 shows a perspective view of a further embodiment of the invention utilizing two clamping arms on a clamping member for vertically clamping a workpiece in a desired position.

FIG. 7 shows a further embodiment of clamp 14 applied to platen 10 as it clamps wedgepiece 21 in a desired position. Clamp 21 has dual clamping arms 26 extending from a single sleeve 28. Each clamping arm 26 has a threaded clamping bolt 34 with corresponding tightening pins 38 and feet 36.

Figure 8:
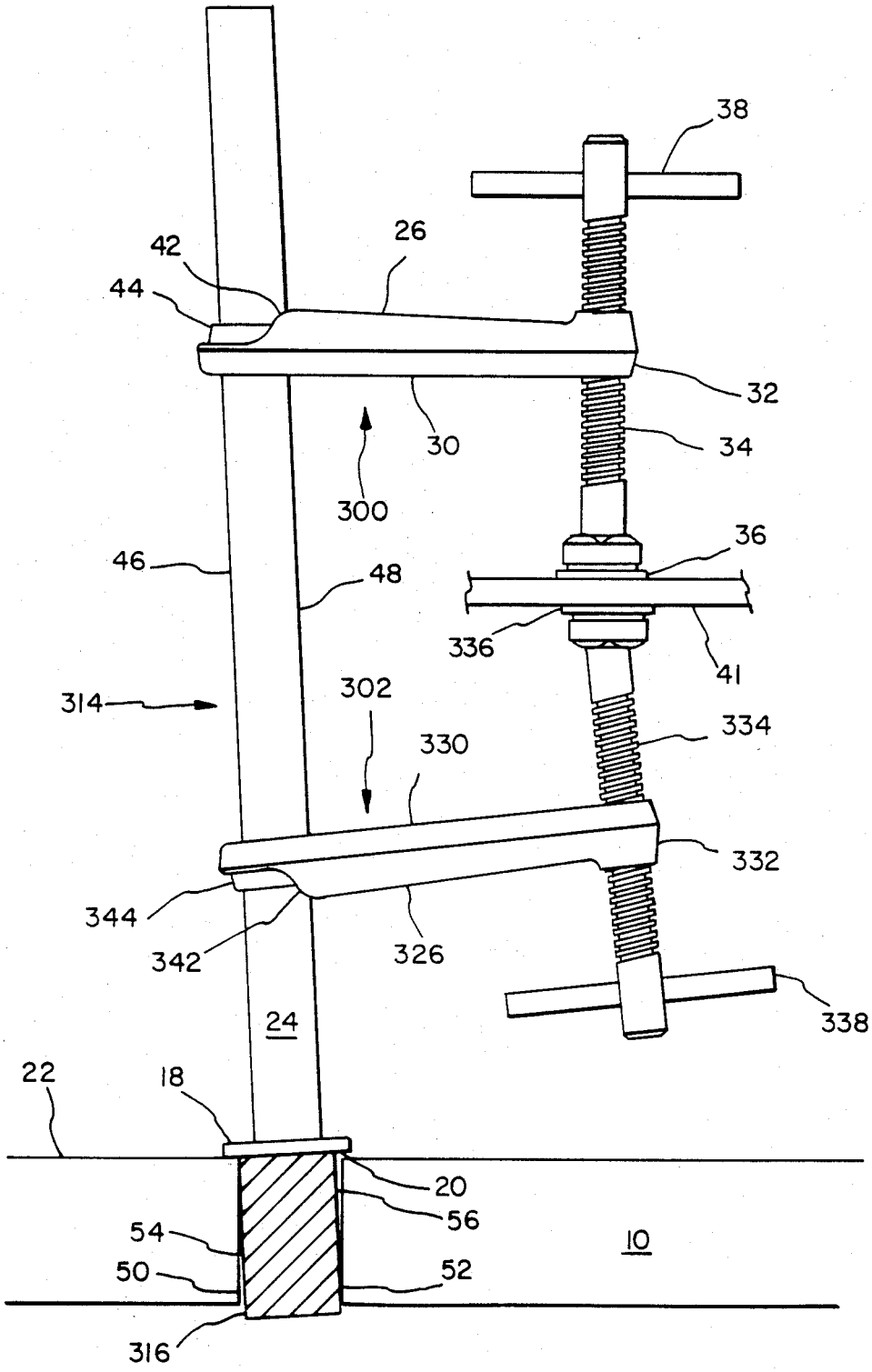
FIG. 8 is a side elevational view of a clamp manifesting aspects of the invention, vertically and inverted vertically clamping a workpiece in a desired position.

FIG. 8 shows still another embodiment of clamp 14, clamping workpiece 41 vertically from above and below. Upper clamp 300 has a slidably mounted clamping arm 26 consisting of sleeve portion 28 surrounding upright 24, neck 30 extending longitudinally from sleeve 28 and frame 32 connected to the opposite end of neck 30. Threaded clamping bolt 34 engages threads interiorolly disposed within frame 32 and has foot 36 on one end and tightening pin 38 on the other.

Sleeve 28 is specifically designed and sized to permit slighting movement along upright 24. Sleeve 28 further permits specifically designed slight pivotal movement of clamping arm 26. This is accomplished by having raised edge 42 adjacent neck 30. Sleeve 28 also has lowered edge 44 on the side opposite raised edge 42. The presence of lowered edge 44 permits sleeve 28 to ride upwardly along left side of upright 24 and simultaneously permits sleeve 28 to ride downwardly along right side 48 of upright 24.

Lower clamp 302 has a slidably mounted clamping arm 326 consisting of sleeve portion 328 surrounding upright 24, neck 330 extending longitudinally from sleeve 328 and frame 332 connected to the opposite end of neck 330. Threaded clamping bolt 334 engages threads interiorly disposed within frame 332 and has foot 336 on one end and tightening pin 338 on the other end. Sleeve 328 is specifically designed and sized to permit sliding movement along upright 24. Sleeve 328 further permits specifically design slight pivotal movement of clamping arm 326. This is accomplished by having raised edge 342 adjacent neck 330. Sleeve 328 also has lowered edge 344 on the side opposite raised edge 342. The presence of lowered edge 344 permits sleeve 328 to ride downwardly along left side 46 of upright 24 and simultaneously permits sleeve 328 to ride upwardly along right side 48 of upright 24. Base 16 has a special "knurled" surface to enhance its gripping capabilities with respect to platen 10.

Figure 9:
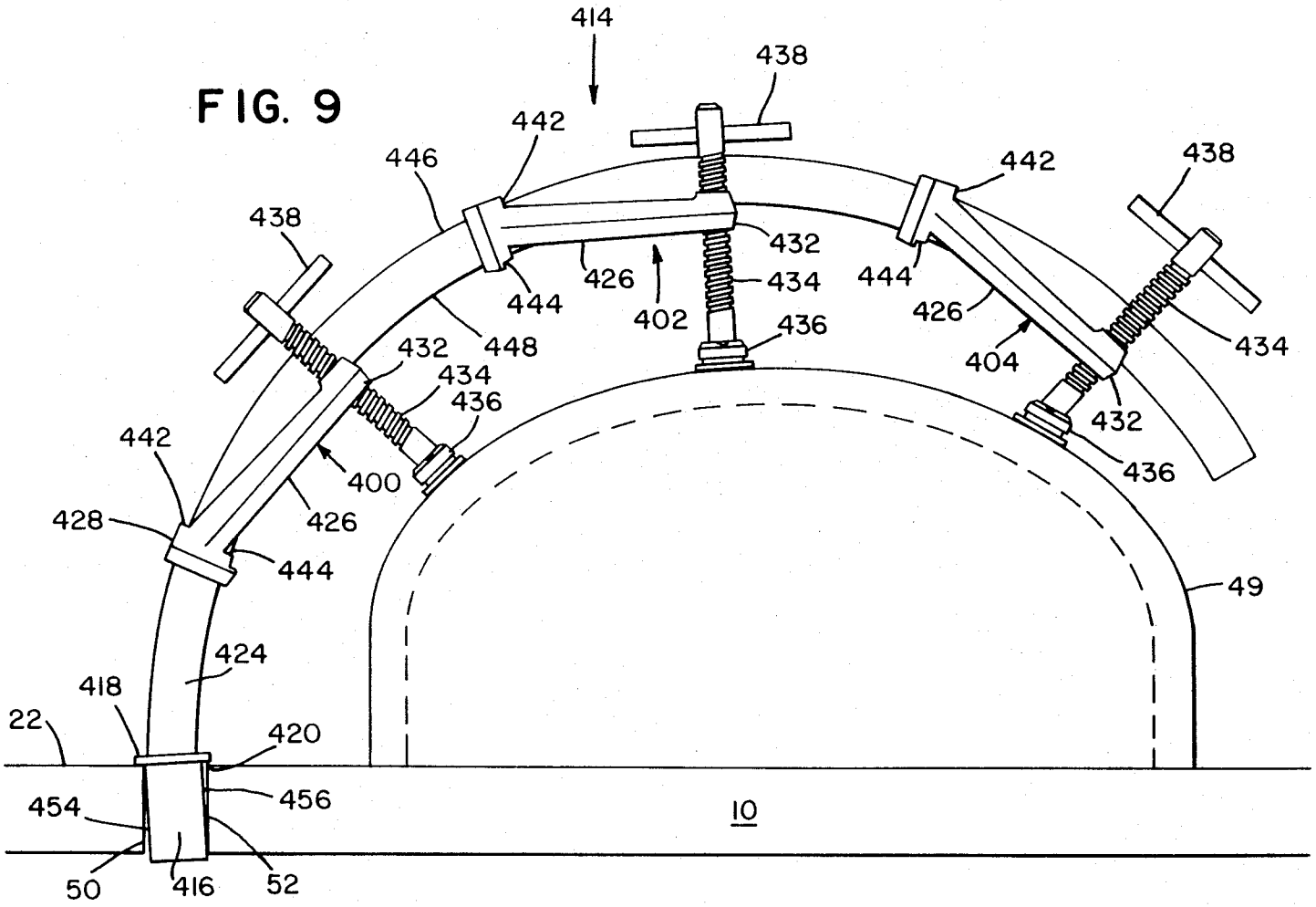
FIG. 9 is a side elevational view of yet another embodiment of the invention clamping a workpiece in a desired position from several points along an arc.

FIG. 9 shows still a further embodiment of a clamp in accordance with the invention. Clamp 414 has a series of clamping members 400, 402 and 404 mounted to specially designed curved upright 424. Each clamping member 400, 402 and 404 has a slidably mounted clamping arm 426 consisting of sleeve portion 428 surrounding upright 424, neck 430 extending longitudinally from sleeve 428 and frame 432 connected to the opposite end of neck 430. Threaded clamping bolt 434 engages threads interiorly disposed within frame 432 and has foot 436 on one end and tightening pin 438 on the other end.

Sleeve 428 is specifically designed and sized to permit sliding movement along upright 424. Sleeve 428 further permits specifically designed slight pivotal movement of clamping arm 426. This is accomplished by having raised edge 442 adjacent neck 430. Sleeve 428 also has lowered edge 444 on the side opposite raised edge 442. The presence of lowered edge 444 permits sleeve 428 to ride upwardly along left side 446 of upright 424 and simultaneously permits sleeve 428 to ride downwardly along right side 448 of upright 424.

Referring back to FIGS. 2 and 3, a workpiece may be vertically clamped to a welding platen as described below. Workpiece 40 is preliminarily placed into a desired position. Base 16 of clamp 14 is then positioned within a square hole 12 at a location sufficient to permit engagement of foot 36 with workpiece 40. It is an important advantage of the invention that no tools are necessary to assist in placing base 16 into the desired hole 12. Flange 18 prevents the clamp from sliding downwardly through hole 12, which typically has no bottom floor. The specific design of flange 18 is unimportant so long as it prevents excessive downward positioning of the clamp. However, it is important that the maximum width of flange 18 not be excessive. Excessive width will impede proper tilting of upright 24. It is also important that flange 18 extends outwardly toward workpiece 40. This ensures that proper pivoting of flange 18 occurs when upright 24 is angled out of vertical. Clamping arm 26 is permitted to slide downwardly along upright 24 until foot 36 engages workpiece 40. Removable pin 25 prevents clamping arm 26 from sliding too far upwardly and off upright 24.

As shown in FIG. 3, tightening pin 38 is rotated to apply downward force by way of clamping bolt 34 and foot 36 to workpiece 40. Foot 36 is most preferably pivotable to enhance clamping force applied against workpiece 40. Pivotability ensures that foot 36 is in the proper plane with workpiece 40, irrespective of the degree of angling of upright 24. Application of clamping force causes clamping arm 26 to raise upwardly by the distance shown between the arrows A and B in FIG. 2. This in turn causes upright 24 to tilt out of vertical as shown by the lines E and F.

Shifting upright 24 out of vertical causes an upper portion of left side surface 54 of base 16 to contact an upper portion of left wall 50 of square hole 12. Similarly, such tilting causes a lower portion of right side surface 56 of base 16 to contact a lower portion of right wall 52 of square hole 12. This ensures that base 16 remains tightly secured within square hole 12 and is not free to move upwardly out of square hole 12. This permits the simultaneous secure and tight clamping of workpiece 40 by clamp 14.

Referring now to FIGS. 4 and 5, the procedure for clamping workpiece 58 into a desired position is substantially the same as that with the clamp shown in FIGS. 2 and 3. First, workpiece 58 is placed in a desired position on top surface 22 of platen 10. Clamp 16 is then placed within a square hole 12 located sufficiently close to workpiece 58 to permit foot 136 to contact workpiece 58 upon initiation of clamping action. Clamping arm 126 is vertically positioned along upright 124 in a manner to permit foot 136 to contact workpieces 58. Tightening pin 138 is then rotated to permit clamping bolt 34 and foot 136 to forcibly contact workpiece 158 and to apply horizontal clamping force thereto.

Application of clamping force to workpiece 58 causes clamping arm 126 to rotate slightly by the distance shown between the arrows H and I which in turn causes displacement of upright 124 out of vertical as shown by arrow G.

Displacement of upright 124 causes similar displacement of base 116. Base 116 becomes tightly wedged into position within square hole 12 by an upper portion of left side surface 154 contacting an upper portion of left wall 50. Similarly, a lower portion of right side surface 56 contacts a lower portion of right wall 52 in order to ensure that base 116 remains tightly secured within square hole 112. In this manner, workpiece 58 is tightly and securely horizontally clamped into a desired position.

As shown in FIGS. 2 and 3, pivoting movement of clamping arm 26 occurs because of the specific construction of sleeve 28. Raised edge 42 acts to resist upward pivoting of clamping arm 26 relative to the amount of downward pivoting of clamping arm 26 permitted by lowered edge 44. It is important that lowered edge 44 be located distally of clamping bolt 34 and raised edge 42 be located proximally of clamping bolt to achieve the tilting direction shown by lines E and F.

Reversal of the relative positions of lowered edge 44 and raised edge 42 would reverse the direction of pivotability of clamping arm 26 and cause upright 24 to tilt toward workpiece 40.

Base 16 is preferably constructed in a cylindrical shape. Such a configuration is far more effective in clamping in that its reduced potential contact with the side walls of hole 12 (four small points as opposed to the entire perimeter of a square base) permits use of the clamp in holes 12 that have had their upper edges distorted or deformed. A single deformation along one upper edge of a hole 12 can easily prevent conventional square base clamps from engaging the hole. A cylindrical shape reduces the potential for contact with the distortion or deformation and permits introduction of base 16 into a square hole 12. Other shapes of base 16 are possible, such as a star shape, so long as potential contact with deformed edges is reduced.

The shape of base 16 further permits excellent contact with selected portions of walls 50 and 52 to achieve a tight "wedged" fit upon tilting of upright 24. Base 16 is preferably "knurled" to improve its grip during clamping as shown in FIG. 8 and may be hardened in any manner known in the art to decrease potential wear. It is important that the shape of base 16 have at least two opposing edges that will permit tight contact with walls 50 and 52 and that is of sufficient length to extend below the bottom surface of standard platens. Base 16 is sized to loosely fit within hole 12, thereby facilitating 360° rotatability of the clamp. This increases flexibility of the clamp by permitting an infinite number of clamping positions along an arc within a single hole 12.

The length and shape of upright 24 may be varied to increase flexibility of the clamp. A longer upright 24 is capable of accepting more than one clamping arm 26, such as two or more horizontal clamping arms 16, two or more vertical clamps 14, or any combination thereof. It is further possible to vary the length of clamping bolt 38 to reach into recessed areas. Removable pin 25 permits interchangability of various clamping arms when removed and prevents unwanted disengagement of clamping arms from uprights 24 when in use. Exemplary embodiments of these aspects of the invention are specifically set forth in FIGS. 8 and 9. The embodiment disclosed in FIG. 8 for the first time permits not only upside down vertical clamping, but both upside down vertical clamping and rightside up vertical clamping. This is an important feature never before contemplated by the prior art.

Although this invention has been described in connection with specific forms thereof, it should be appreciated that a wide array of equivalents may be substituted for the specific elements shown and described herein without departing from the spirit and scope of this invention as described in the appended claims.

I claim:

1. A clamp adapted to engage a clamp receiving hole in a welding platen for tightly clamping a workpiece in a desired position comprising:

an elongated upright capable of extending into said hole and being free of connection to said platen;

a stop member extending outwardly from a lower portion of said upright, said stop having a portion wider than the mouth of said hole, thereby limiting the distance said upright extends into said hole;

a clamping arm slidably mounted to said upright, said clamping arm comprising an elongated neck and a sleeve connected to said neck and engaging said upright, said sleeve permitting changes in the angular position of said neck with respect to said upright; and workpiece engaging means connected to said neck and capable of applying force to said workpiece wherein tightening of said engaging means against said workpiece causes said clamping arm to pivot with respect to said upright, thereby causing said upright to tilt and tightly engage opposing sides of said hole which causes said upright to remain wedged in said hole and said workpiece to be tightly clamped.

2. The clamp defined in claim 1 wherein said neck extends substantially perpendicularly to a central axis extending through the open portion of said sleeve.

3. The clamp defined in claim 1 wherein said neck extends substantially parallel to a central axis extending through the open portion of said sleeve.

4. The clamp defined in claim 1 wherein said sleeve has one side adjacent said neck and engaging said upright with a greater height than a second opposite side engaging said upright.

5. A clamp adapted to engage a clamp receiving hole in a welding platen for tightly clamping a workpiece in a desired position comprising:

an elongated base member capable of extending into said hole and being free of connection to said platen;

a flange extending outwardly from an upper portion of said base, said flange having a portion wider than the mouth of said hole, thereby limiting the distance of said base extends into said hole;

an elongated upright extending outwardly from an upper portion of said base;

a clamping arm slidably mounted to said upright, said clamping arm comprising an elongated neck and a sleeve connected to said neck and engaging said upright, said sleeve permitting changes in the angular position of said neck with respect to said upright; and workpiece engaging means connected to said neck and capable of applying force to said workpiece wherein tightening said engaging means against said workpiece causes said clamping arm to pivot with respect to said upright, thereby causing said upright to tilt and tightly engage opposing sides of said hole which causes said upright to remain wedged in said hole and said workpiece to be tightly clamped.

6. The clamp defined in claim 5 wherein said neck extends substantially perpendicularly to a central axis extending through the open portion of said sleeve.

7. The clamp defined in claim 5 wherein said neck extends substantially parallel to a central axis extending through the open portion of said sleeve.

8. The clamp defined in claim 5 wherein said flange extends radially outwardly from said base.

9. The clamp defined in claim 5 wherein said sleeve has one side adjacent said neck and engaging said upright with a greater height than a second opposite side engaging said upright.

10. The clamp defined in claim 1 further comprising a second sleeve connected to said clamping arm adjacent the other sleeve such that an axis extending through the open portion of said second sleeve is substantially perpendicular to an axis extending through the open portion of the other sleeve.

11. The clamp defined in claim 5 further comprising a second sleeve connected to said clamping arm adjacent the other sleeve such that an axis extending through the open portion of said second sleeve is substantially perpendicular to an axis extending through the open portion of the other sleeve.

12. The clamp defined in claim 1 further comprising a second clamping arm slidably mounted to said upright, said second clamping arm comprising a second elongated neck and a second sleeve connected to said second neck and engaging said upright, said second sleeve permitting changes in angular position of said second neck with respect to said upright; and second workpiece engaging means connected to said second neck and capable of applying force to said workpiece in a direction substantially opposite the direction of force applied by the other workpiece engaging means.

13. The clamp defined in claim 5 further comprising a second clamping arm slidably mounted to said upright, said second clamping arm comprising a second elongated neck and a second sleeve connected to said second neck and engaging said upright, said second sleeve permitting changes in angular position of said second neck with respect to said upright; and second workpiece engaging means connected to said second neck and capable of applying force to said workpiece in a direction substantially opposite the direction of force applied by the other workpiece engaging means.

14. The clamp defined in claim 1 wherein a portion of said elongated upright is curved.

15. The clamp defined in claim 14 further comprising a second clamping arm slidably mounted to said upright, said second clamping arm comprising a second elongated neck and a second sleeve connected to said second neck and engaging said upright, said second sleeve permitting changes in angular position of said second neck with respect to said upright; and second workpiece engaging means connected to said second neck and capable of applying force to said workpiece wherein tightening of said second engaging means against said workpiece causes said clamping arm to pivot with respect to said upright, thereby causing said upright to tilt and tightly engage opposing sides of said hole which causes said upright to wedge in said hole and said workpiece to be tightly clamped.

16. A clamp adapted to engage a clamp receiving hole in a welding platen for tightly clamping a workpiece in a desired position comprising:

an elongated upright capable of extending into said hoel and being free of connection to said platen;

a stop member extending outwardly from a lower portion of said upright, said stop having a portion wider than the mouth of said hole, thereby limiting the distance said upright extends into said hole;

a clamping arm slidably mounted to said upright, said clamping arm comprising a frame portion, an elongated neck extending from said frame and a sleeve connected to said neck and engaging said upright, wherein said neck extends substantially perpendicularly to a central axis extending through the open portion of said sleeve, said sleeve permitting changes in the angular position of said neck with respect to said upright, a second frame portion and a second neck extending from said sleeve, said second neck extending substantially perpendicular to said central axis; and workpiece engaging means connected to said frame and capable of applying force to said workpiece wherein tightening of said engaging means against said workpiece causes said clamping arm to pivot with respect to said upright, thereby causing said upright to tilt and tightly engage two opposing sides of said hole which causes said upright to remain wedged in said hole and said workpiece to be tightly clamped.

17. A clamp adapted to engage a clamp receiving hole in a welding platen for tightly clamping a workpiece in a desired position comprising:

an elongated base member capable of extending into said hoel and being free of connection to said platen;

a flange extending outwardly from an upper portion of said base, said flange having a portion wider than the mouth of said hole, thereby limiting the distance of said base extends into said hole;

an elongated upright extending outwardly from an upper portion of said base;

a clamping arm slidably mounted to said upright, said clamping arm comprising a frame portion, an elongated neck extending from said frame and a sleeve connected to said neck and engaging said upright, wherein said neck extends substantially perpendicularly to a central axis extending through the open portion of said sleeve, said sleeve permitting changes in the angular position of said neck with respect to said upright, a second frame portion and a second neck extending from said sleeve, said second neck extending substantially perpendicular to said central axis; and workpiece engaging means connected to said frame and capable of applying force to said workpiece wherein tightening said engaging means against said workpiece causes said clamping arm to pivot with respect to said upright, thereby causing said upright to tilt and tightly engage two opposing sides of said hole which causes said upright to remain wedged in said hole and said workpiece to be tightly clamped.

* * * * *